US008973914B2

(12) United States Patent
Kozaki

(10) Patent No.: US 8,973,914 B2
(45) **Date of Patent: *Mar. 10, 2015**

(54) SHEET-SUPPLY DEVICE WITH A SHEET-SEPARATION UNIT HAVING AN OPENING

(71) Applicant: Brother Kogyo Kabushiki Kaisha, Nagoya-shi, Aichi-ken (JP)

(72) Inventor: Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/792,385

(22) Filed: Mar. 11, 2013

(65) Prior Publication Data

US 2013/0187327 A1 Jul. 25, 2013

Related U.S. Application Data

(63) Continuation of application No. 11/209,756, filed on Aug. 24, 2005, now Pat. No. 8,393,611.

(51) Int. Cl.
*B65H 1/00* (2006.01)
*B41J 11/00* (2006.01)
(Continued)

(52) U.S. Cl.
CPC ..... *B65H 1/00* (2013.01); *B41J 11/0025* (2013.01); *B41J 11/006* (2013.01); *B41J 13/103* (2013.01); *B65H 1/04* (2013.01); *B65H 3/5223* (2013.01)
USPC ..... 271/145; 271/171

(58) Field of Classification Search
USPC ..... 271/145
See application file for complete search history.

(56) References Cited

U.S. PATENT DOCUMENTS 3,934,870 A 1/1976 Miller et al.
4,319,282 A 3/1982 Hartman, Jr. et al.
(Continued)

FOREIGN PATENT DOCUMENTS

JP 8-081071 A 3/1996
JP 2000-344372 A 12/2000
(Continued)

OTHER PUBLICATIONS

Office Action in corresponding Japanese Application No. 2004-244308, mailed May 20, 2009, and English language translation thereof.
(Continued)

*Primary Examiner* — Gerald McClain
(74) *Attorney, Agent, or Firm* — Banner & Witcoff, Ltd.

(57) ABSTRACT

A sheet-supply cassette includes a main member open upward and adapted to store a plurality of recording sheets stacked on each other, each of which is separated from the other recording sheets, and is fed in a sheet-feed direction, by a sheet feeder, an inclined sheet-separate plate provided in a downstream-side portion of the main member as seen in the sheet-feed direction, and which cooperates with the sheet feeder to separate the each recording sheet from the other recording sheets, and a plurality of back-surface support portions which are formed integrally with the downstream-side portion of the main member, such that the back-surface support portions are distant from each other in a perpendicular direction substantially perpendicular to the sheet-feed direction. The inclined sheet-separate plate is detachably attached to the back-surface support portions such that a back surface of the inclined sheet-separate plate is supported by the back-surface support portions.

10 Claims, 14 Drawing Sheets

(51) Int. Cl.

| | |
|---|---|
| ***B41J 13/10*** | (2006.01) |
| ***B65H 1/04*** | (2006.01) |
| ***B65H 3/52*** | (2006.01) |

(56) References Cited

U.S. PATENT DOCUMENTS

| | | | | |
|---|---|---|---|---|
| 4,457,507 | A | 7/1984 | Ishikawa et al. | |
| 4,511,904 | A | 4/1985 | Takahashi | |
| 4,869,488 | A | 9/1989 | Hirota et al. | |
| 4,884,082 | A | 11/1989 | Sonoda et al. | |
| 5,188,351 | A | 2/1993 | Gysling | |
| 5,238,235 | A | 8/1993 | Nitta et al. | |
| 5,313,257 | A | 5/1994 | Kashima et al. | |
| 5,333,852 | A | 8/1994 | Milillo et al. | |
| 5,348,283 | A | 9/1994 | Yanagi et al. | |
| 5,433,427 | A | 7/1995 | Ishikawa et al. | |
| 5,437,444 | A | 8/1995 | Kawakami et al. | |
| 5,454,555 | A | 10/1995 | Kiyohara et al. | |
| 5,480,247 | A | 1/1996 | Saikawa et al. | |
| 5,537,195 | A | 7/1996 | Sagara et al. | |
| 5,624,107 | A | 4/1997 | Deguchi et al. | |
| 5,727,883 | A | 3/1998 | Kusano et al. | |
| 5,738,453 | A | 4/1998 | Tsuburaya et al. | |
| 5,815,787 | A | 9/1998 | Crayton et al. | |
| 5,895,040 | A * | 4/1999 | Oleksa et al. | 271/124 |
| 6,000,692 | A | 12/1999 | Lee | |
| 6,105,956 | A | 8/2000 | Park | |
| 6,131,899 | A | 10/2000 | Nojima et al. | |
| 6,249,295 | B1 | 6/2001 | Kiyohara et al. | |
| 6,260,842 | B1 | 7/2001 | Nelson et al. | |
| 6,416,050 | B1 | 7/2002 | Niikura | |
| 6,561,506 | B2 | 5/2003 | Sasaki et al. | |
| 6,629,693 | B2 * | 10/2003 | Siow et al. | 271/171 |
| 6,938,893 | B2 | 9/2005 | Shin | |
| 6,975,831 | B2 | 12/2005 | Kumadaki et al. | |
| 6,985,265 | B2 | 1/2006 | Ito | |
| 7,014,186 | B2 | 3/2006 | Shiohara et al. | |
| 7,059,597 | B2 | 6/2006 | Shirakura et al. | |
| 7,097,172 | B2 | 8/2006 | Chang | |
| 8,393,611 | B2 * | 3/2013 | Kozaki | 271/145 |
| 2003/0184004 | A1 | 10/2003 | Shiohara et al. | |
| 2004/0017039 | A1 * | 1/2004 | Asada et al. | 271/121 |
| 2004/0032077 | A1 | 2/2004 | Oh et al. | |
| 2004/0041334 | A1 | 3/2004 | Yoshihara | |
| 2004/0084831 | A1 | 5/2004 | Asada | |
| 2005/0194734 | A1 * | 9/2005 | Asada et al. | 271/121 |
| 2005/0275156 | A1 * | 12/2005 | Flynn et al. | 271/167 |

FOREIGN PATENT DOCUMENTS

| | | | |
|---|---|---|---|
| JP | 2001-088947 | A | 4/2001 |
| JP | 2002-173240 | A | 6/2002 |
| JP | 2003-285948 | A | 10/2003 |

OTHER PUBLICATIONS

Hewlett-Packard Company, HP Officejet 630 All-in-One: Manuals, 1997, http://h10032.www1.hp.com/ctg/Manual/bpu60078.pdf, pp. 1-2, 1-3, 1-6, 7-22.

* cited by examiner

SHEET-SUPPLY DEVICE WITH A SHEET-SEPARATION UNIT HAVING AN OPENING

The present application is a continuation of co-pending U.S. application Ser. No. 11/209,756, filed Aug. 24, 2005, which claims priority to Japanese Patent Application No. 2004-244308 filed on Aug. 24, 2004, the entire contents of which are incorporated herein by reference.

BACKGROUND OF THE INVENTION

1. Field of the Invention

The present invention relates to a sheet-supply cassette, and an image recording apparatus, such as a printer, a copier, or a facsimile machine, that includes a sheet-supply cassette.

2. Discussion of Related Art

There has been known a sheet-supply cassette that is employed by an image recording apparatus such as a printer, a copier, or a facsimile machine and supplies, one by one, a plurality of cut recording sheets each as a recording medium. The sheet-supply cassette includes a main member in which a plurality of cut recording sheets are horizontally stacked on each other so that the top one of the stacked cut sheets is fed by a sheet-feed roller pressed against it; and an inclined, sheet-separate plate which is provided in a downstream end portion of the main member as seen in a sheet-feed direction in which each cut sheet is fed. A leading end of each cut sheet being fed is engaged with a front surface of the sheet-separate plate so that the each cut sheet is separated from the other cut sheets and is fed forward.

In the above-described conventional sheet-supply cassette, the sheet-separate plate is provided in the downstream end portion of the main member, such that the entirety of the sheet-separate plate is inclined. Therefore, the entire length of the leading end of each cut sheet being fed simultaneously engages the front surface of the sheet-separate plate, thereby receiving too great a frictional resistance. In particular, in the case where a thick cut sheet is fed, the thick cut sheet may not be smoothly curved by the front surface of the sheet-separate plate and accordingly the feeding of the thick cut sheet may fail.

In the above-described background, Japanese Patent Application Publication No. 2002-173240 had proposed a sheet-supply cassette including a main member; a plurality of inclined sheet-separate plates that are provided on an inner surface of a side wall of the main member that is located on a downstream end of the main member as seen in a sheet-feed direction, such that the inclined sheet-separate plates are distant from each other in a widthwise direction of each cut recording sheet; and a plurality of pairs of inclined sheet-guide plates which have respective inclined sheet-guide surfaces. Each pair of inclined sheet-guide plates are provided on either side of a corresponding one of the inclined sheet-separate plates in the widthwise direction, and the inclined sheet-guide plates cooperate with each other to guide a plurality of portions of the leading end of each cut sheet that do not contact the inclined sheet-separate plates. Thus, the sheet-supply cassette allows each cut recording sheet to be fed while the leading end portion thereof is smoothly curved in an upward direction without being damaged.

However, in the sheet-supply cassette disclosed by the above-indicated document, the inclined sheet-separate plates and the inclined sheet-guide plates are spaced from each other in the widthwise direction of each cut recording sheet. Therefore, the leading end of each cut sheet may be abruptly bent, or may be damaged, at the boundary between each of those plates and a vacant space adjacent to the each plate.

SUMMARY OF THE INVENTION

In the above-described technical background, the present invention has been developed. It is therefore an object of the present invention to provide a sheet-feed cassette and an image recording apparatus each of which is free of at least one of the above-indicated problems. It is another object of the present invention to provide a sheet-feed cassette and an image recording apparatus each of which does not damage a leading end of each recording sheet being fed and can be easily produced and assembled, According to a first aspect of the present invention, there is provided a sheet-supply cassette, comprising a main member which is open upward and which is adapted to store a plurality of recording sheets which are stacked on each other and each one of which is separated from the other recording sheets, and is fed in a sheet-feed direction, by a sheet feeder; an inclined sheet-separate plate which is provided in a downstream-side portion of the main member as seen in the sheet-feed direction, and which cooperates with the sheet feeder to separate the each recording sheet from the other recording sheets; and a plurality of back-surface support portions which are formed integrally with the downstream-side portion of the main member, such that the back-surface support portions are distant from each other in a perpendicular direction substantially perpendicular to the sheet-feed direction. The inclined sheet-separate plate is detachably attached to the back-surface support portions such that a back surface of the inclined sheet-separate plate is supported by the back-surface support portions.

In the sheet-supply cassette in accordance with the first aspect of the present invention, the sheet-separate plate, i.e., the single plate is formed separately from the main member, and subsequently the sheet-separate plate is detachably attached to the back-surface support portions such that the plate is inclined relative to the main member. Therefore, the inclined sheet-separate plate can be easily formed to have an accurate shape. In particular, in the case where the sheet-separate plate has a continuously curved front surface, such as an arcuate surface, the three-dimensional curved surface can be more easily and accurately formed as compared with a case where the three-dimensional curved surface is formed by, e.g., injection molding of a synthetic resin, integrally with the main member.

According to a second aspect of the present invention, there is provided an image recording apparatus comprising the sheet-supply cassette according to the first aspect of the present invention; an accommodating portion which accommodates the sheet-supply cassette such that the sheet-supply cassette can be inserted in, and drawn from, the accommodating portion in opposite directions, respectively, that are parallel to the sheet-feed direction; and a snap-action device which causes a snap action at each of (a) a first time when the sheet-supply cassette is inserted in the accommodating portion and (b) a second time when the sheet-supply cassette is drawn from the accommodating portion.

Since the image recording apparatus in accordance with the second aspect of the present invention employs the sheet-supply cassette in accordance with the first aspect of the present invention, the image recording apparatus can enjoy the same advantages as the above-described advantages of the sheet-supply cassette.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
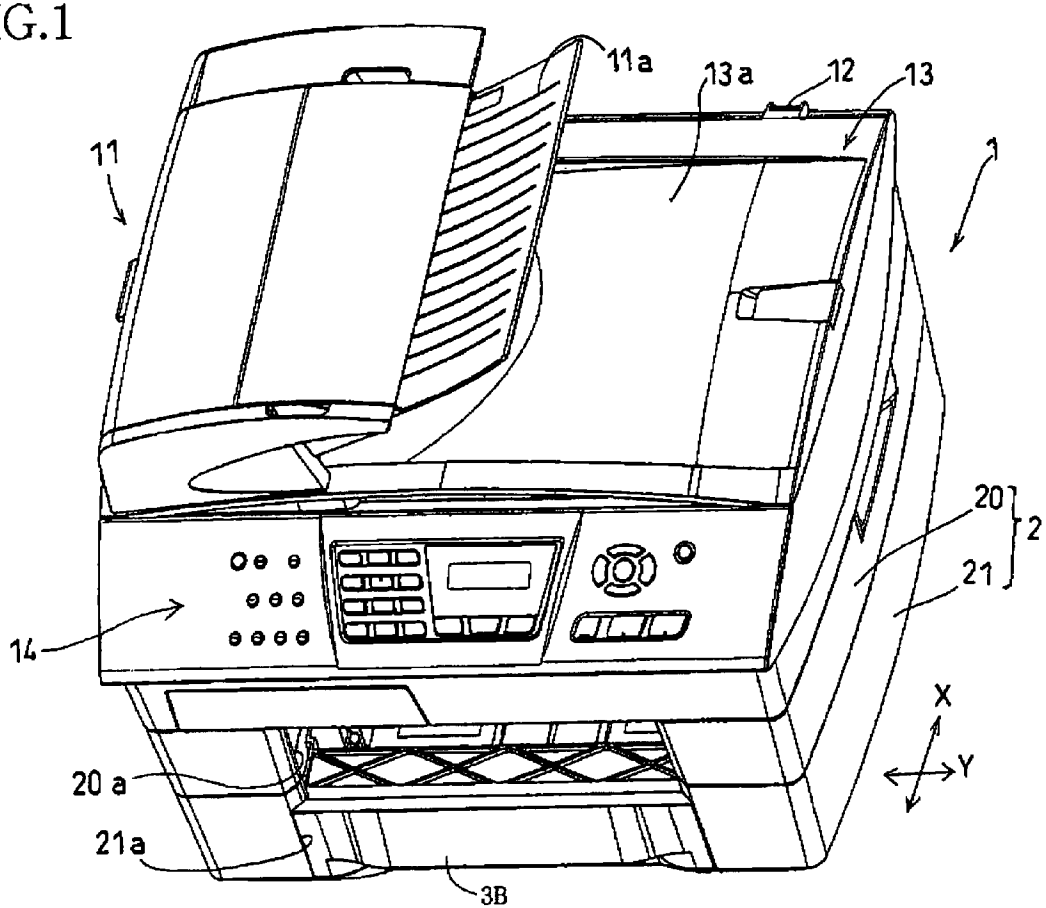
FIG. 1 is a perspective view of an image recording apparatus as an embodiment of the present invention.

Hereinafter, there will be described preferred embodiments of the present invention by reference to the drawings. FIG. 1 shows an image recording apparatus 1 to which the present invention is applied. The image recording apparatus 1 is a so-called "multi-function device (MFD)" that has a printer function, a copier function, a scanner function, and a facsimile-machine function. As shown in the figure, the image recording apparatus 1 includes a housing 2 that is formed of a synthetic resin and includes a first lower case 20 and a second lower case (i.e., a lowermost case) 21 that is connected to the bottom of the first lower case 20; an upper sheet-supply cassette 3A (FIGS. 2 and 3) that is insertable into an opening 20*a* provided in a front-side portion of the first lower case 20; and a lower sheet-supply cassette 3B that is insertable into an opening 21*a* provided in a front-side portion of the second lower case 21. FIG. 1 shows a state in which the lower sheet-supply cassette 3B is inserted in the housing 2 but the upper sheet-supply cassette 3A is not inserted in the same 2. In the following description of each of the components, such as the housing 2, the first lower case 20, the second lower case 21, or the upper or lower sheet-supply cassette 3A, 3B, a portion, an end, or a side of the each component that is located nearer to the openings 20*a*, 21*a* will be referred to as a front portion, a front end, or a front side of the each component, and a portion, an end, or a side of the each component that is located opposite to the openings 20*a*, 21*a* will be referred to as a rear portion, a rear end, or a rear side of the each component.

In a top portion of the image recording apparatus 1, there are provided an image reading device, not shown, including an automatic original-sheet feeder 11 that automatically feeds an original sheet bearing an original image, so as to read the original image in a copier or facsimile-machine mode, and an operation panel 14 that is located in front of the image reading device and includes various sorts of operation keys and a liquid-crystal display (FIG. 1). The image reading device additionally includes an original-sheet support glass plate, not shown, that supports, on an upper surface thereof, an original sheet and can be covered by an original-sheet cover member 13 whose rear end is connected via hinges 12 to a rear end of the image reading device such that the cover member 13 is pivotable upward and downward about the hinges 12. When a user opens the cover member 13 by pivoting the same 13 upward, and places an original sheet on the upper surface of the support glass plate, an image scanner (e.g., a contact image sensor (CIS)) that is provided below the support glass plate is reciprocated in a main scanning direction, i.e., a Y-axis direction in FIG. 1, so as to read an original image borne by the original sheet. The Y-axis direction is perpendicular to the drawing sheet of FIG. 2. Meanwhile, an original sheet that is placed on an original-sheet supply plate 11 a of the automatic original-sheet feeder 11 is fed downward so that an original image borne by the original sheet is read by the image scanner in an original-image reading area, not shown, that is provided in a left-hand end portion of the support glass plate in FIG. 1, and then the original sheet is discharged onto an original-sheet discharge plate 13*a*, i.e., an upper wall of the cover member 13.

Figure 2:
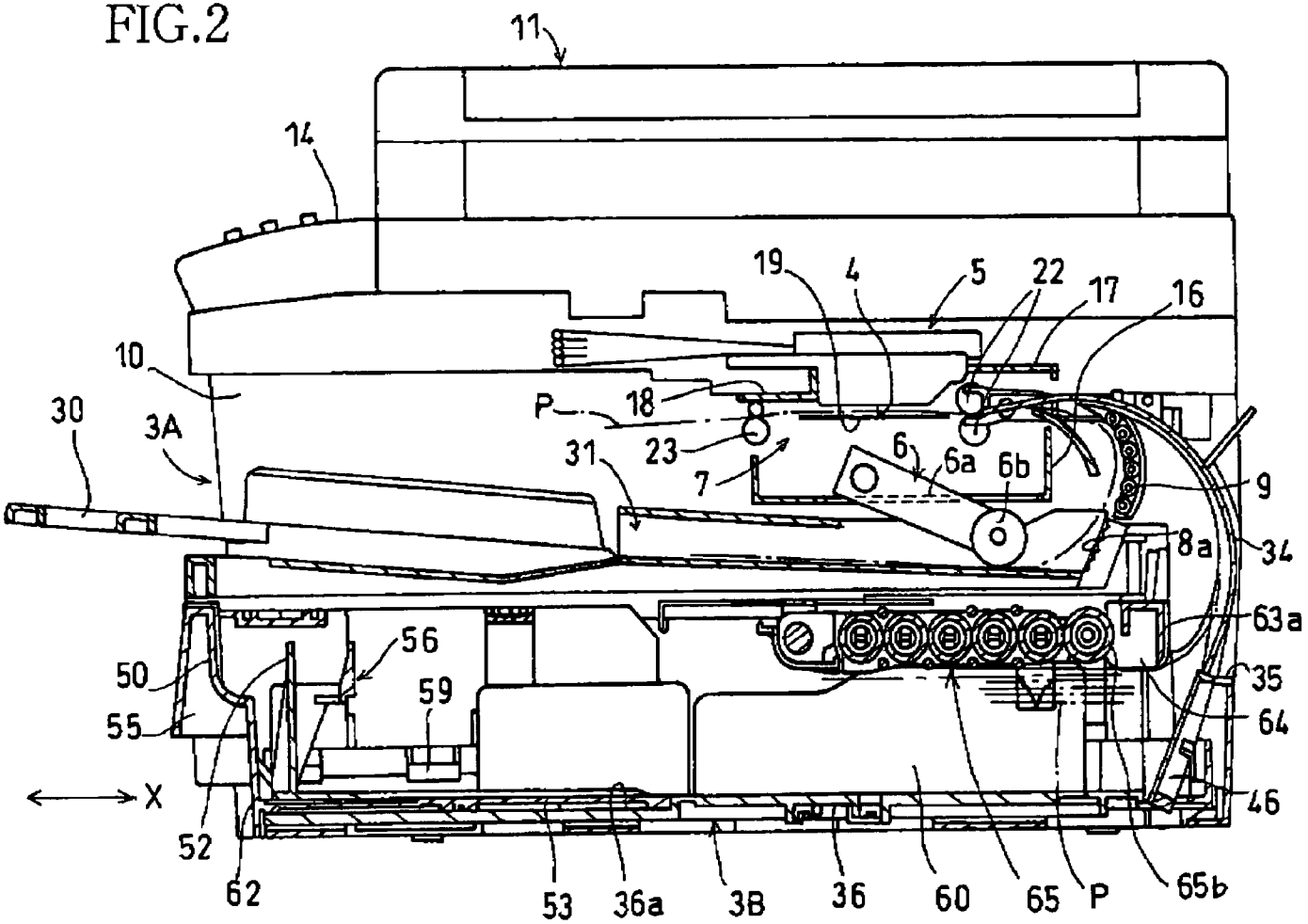
FIG. 2 is a cross-section view of two sheet-supply cassettes of the image recording apparatus.
Figure 3:
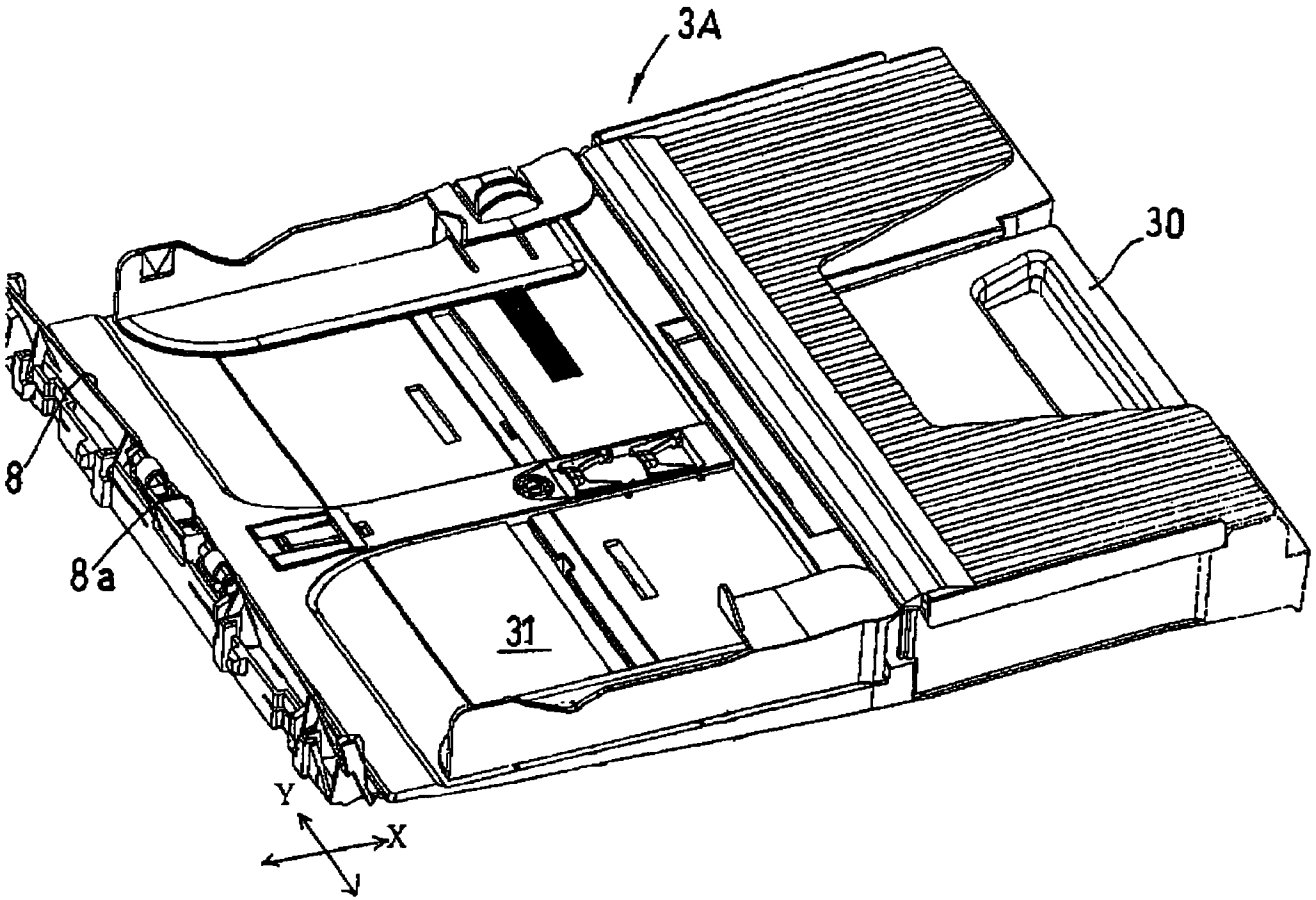
FIG. 3 is a perspective view of an upper one of the two sheet-supply cassettes.

Under the operation panel 14 and the image reading device, there are provided a recording portion 7 and a sheet discharging portion 10, as shown in FIG. 2.

As shown in FIG. 2, the recording portion 7 includes two elongate plate-like guide members 17, 18 that are respectively supported by two side walls of a main frame 16 formed of, e.g., a metallic plate and that extend in the Y-axis direction (i.e., the main scanning direction); a carriage 5 that supports a recording head 4 and bridges the two guide members 17, 18 such that the carriage 5 is slidable and reciprocateable on the same 17, 18; a timing belt, not shown, that is provided on an upper surface of the guide member 18, located on a downstream side in a sheet-feed direction, such that the timing belt extends parallel to the guide member 18, and that is driven to reciprocate the carriage 5; a carriage (CR) motor, not shown, that drives the timing belt; a plate-like platen 19 that is provided below a lower surface of the recording head 4 and supports a recording sheet, P, being fed; and a belt-like encoder strip, not shown, that extends in the Y-axis direction and detects a current position of the carriage 5 in the Y-axis direction. The sheet-feed direction is a direction in which the recording sheet P is fed. The encoder strip has a detection surface in which a plurality of slits are formed at a regular interval in the Y-axis direction, and is provided such that the detection surface is vertical.

Two register rollers 22 are provided on an upstream side of the platen 19, and cooperate with each other to pinch and feed the recording sheet P to a space below the lower surface of the recording head 4. On a downstream side of the platen 19, there are provided a spur roller that contacts an upper surface (i.e., a recording surface) of the recording sheet P, and a discharge roller 23 that contacts a lower surface (i.e., a nonrecording surface) of the sheet P. The discharging portion 10 discharges the recording sheet P such that the image-recorded surface of the sheet P, recorded by the recording portion 7, faces upward. The discharging portion 10 is provided above the upper sheet-supply cassette 3A, such that a sheet-discharge opening communicating with the discharging portion 10 is provided in the front wall of the housing 2, more specifically described, is located above the opening 20*a*.

Next, there will be described respective constructions of the two sheet-supply cassettes 3A, 3B. First, the upper sheet-supply cassette 3A that is insertable in the first lower case 20 is described by reference to FIGS. 2 and 3. The upper sheet-supply cassette 3A includes an accommodating portion (i.e., a main portion) 31 that can accommodate a plurality of cut recording sheets P each as a recording medium, such as A4-size sheets, legal-size sheets, letter-size sheets, or post-card-size sheets, such that the sheets P are stacked on each other and respective short sizes of the sheets P extend in a direction (i.e., the direction perpendicular to the drawing sheet of FIG. 2, the main scanning direction, or the Y-axis direction) perpendicular to the sheet-feed direction (i.e., a sub-scanning direction or an X-axis direction). The upper sheet-supply cassette 3A additionally includes, in a front end portion thereof (located nearer to the opening 20*a*), an auxiliary support member 30 that supports respective rear end portions of long cut sheets P, such as legal-size sheets, and is movable relative to the accommodating portion 31 in the X-axis direction. FIG. 2 shows a state in which the auxiliary support member 30 is held at an extended position thereof where a portion of the support member 30 projects out of the housing 2. On the other hand, in the case where short cut sheets P, such as A4-size sheets, that can be fully accommodated by the accommodating portion 31, i.e., do not project out of the first lower case 20 through the opening 20*a* are used, the support member 30 can be retracted into the accommodating portion 31.

In the state in which the auxiliary support member 30 is retracted into the accommodating portion 31 of the upper sheet-supply cassette 3A, a length of the upper cassette 3A in the X-axis direction is substantially equal to that of the image reading device or the operation panel 14 in the Y-axis direction. In this state, therefore, the image recording apparatus 1 has a substantially square shape in its plane view, and also has a generally rectangular parallelepiped shape. Thus, when the apparatus 1 is shipped as a final product from a factory, the apparatus 1 can be easily packed, and a size of a package used to pack the same 1 can be reduced.

In addition, the upper sheet-supply cassette 3A has, in a rear end portion thereof (i.e., a right-hand end portion in FIG. 2, or a left-hand end portion in FIG. 3), an inclined sheet-separate plate 8 that separates each one cut sheet P from the other cut sheets P. An arm 6*a* is pivotally connected, at an upper end portion thereof to the housing 2 such that the arm 6*a* is pivotable upward and downward, and a sheet-supply roller 6*b* is supported by a lower end portion of the arm 6*a*. The arm 6*a* and the roller 6*b* cooperate with each other to provide a sheet-supply drive portion (i.e., a sheet feeder) 6 that cooperates with the inclined sheet-separate plate 8 to separate and feed, one by one, the cut sheets P stacked on each other in the upper sheet-supply cassette 3A. The separated sheet P is fed via a first U-turn path (i.e., a first sheet-convey path) 9 that is initially oriented obliquely upward, and then backward to the recording portion 7 provided at a position higher than the upper sheet-supply cassette 3A. The inclined sheet-separate plate 8 has a convexly curved shape in its plan view in which a middle portion of the plate 8 in a widthwise direction of the sheet P, i.e., the Y-axis direction, swells toward the accommodating portion 31 and opposite end portions of the plate 8 in the Y-axis direction do not swell. On the middle portion of the sheet-separate plate 8, there is provided a serrate elastic sheet-separate pad 8*a* that engages a leading end of each cut sheet P to promote separation of the each cut sheet P from the other cut sheets P.

As shown in FIGS. 2, 4 through 8, and 14, the lower sheet-supply cassette 3B includes a main portion 32 that opens upward and can accommodate a plurality of cut recording sheets P such that the sheets P are stacked on each other; and an auxiliary portion 33 that opens upward, supports respective rear end portions of the sheets P in the sheet-feed direction, i.e., the X-axis direction, and is connected to the main portion 32 such that the auxiliary portion 33 is movable frontward and rearward relative to the main portion 32. Each of the main portion 32 and the auxiliary portion 33 is formed by injection molding of a synthetic resin. In the present embodiment, the auxiliary portion 33 is located nearer to the opening 21*a* provided in the front wall of the second lower case 21. The second lower case 21 that opens upward is connected to the bottom of the first lower case 20, such that the second lower case 21 is joined with, e.g., screws, not shown, to the first lower case 20. A recess 35 is formed in the respective rear end walls of the first and second lower cases 20, 21, and a second U-turn path (i.e., a second sheet-convey path) 34 that is integral with the first U-turn path 9 is detachably attached to the recess 35.

Figure 8:
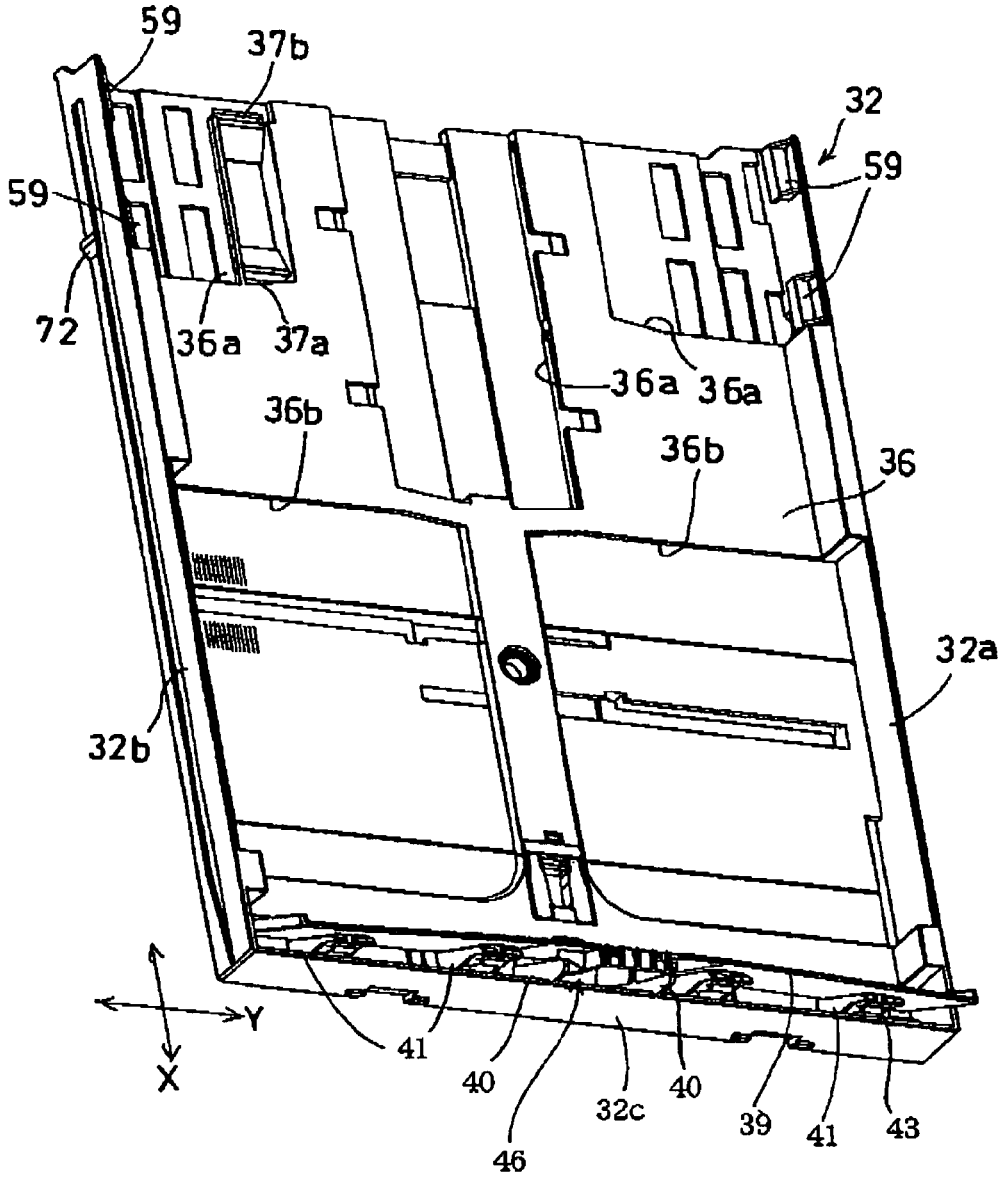
FIG. 8 is a perspective view of a main portion of the lower sheet-supply cassette in a state in which an auxiliary portion of the cassette is removed.

As shown in FIG. 8, the main portion 32 of the lower cassette 3B includes a bottom plate 36, two side plates 32*a*, 32*b*, and a rear plate 32*c*. The bottom plate 36 has, in a front end portion thereof, a plurality of front stepped portions 36*a*, and one of the front stepped portions 36*a* has, at a position deviated by an appropriate distance in one direction from the middle portion of each cut sheet P in the widthwise direction thereof (i.e., the Y-axis direction) perpendicular to the sheet-feed direction, a plurality of engaging grooves 37*a*, 37*b* as a plurality of first engaging portions that respectively define a plurality of engagement positions (described in detail later) of the auxiliary portion 33 that correspond to different lengths of a plurality of sorts of cut sheets P in the sheet-feed direction. The grooves 37*a*, 37*b* are distant from each other by an appropriate distance in the X-axis direction.

Figure 7:
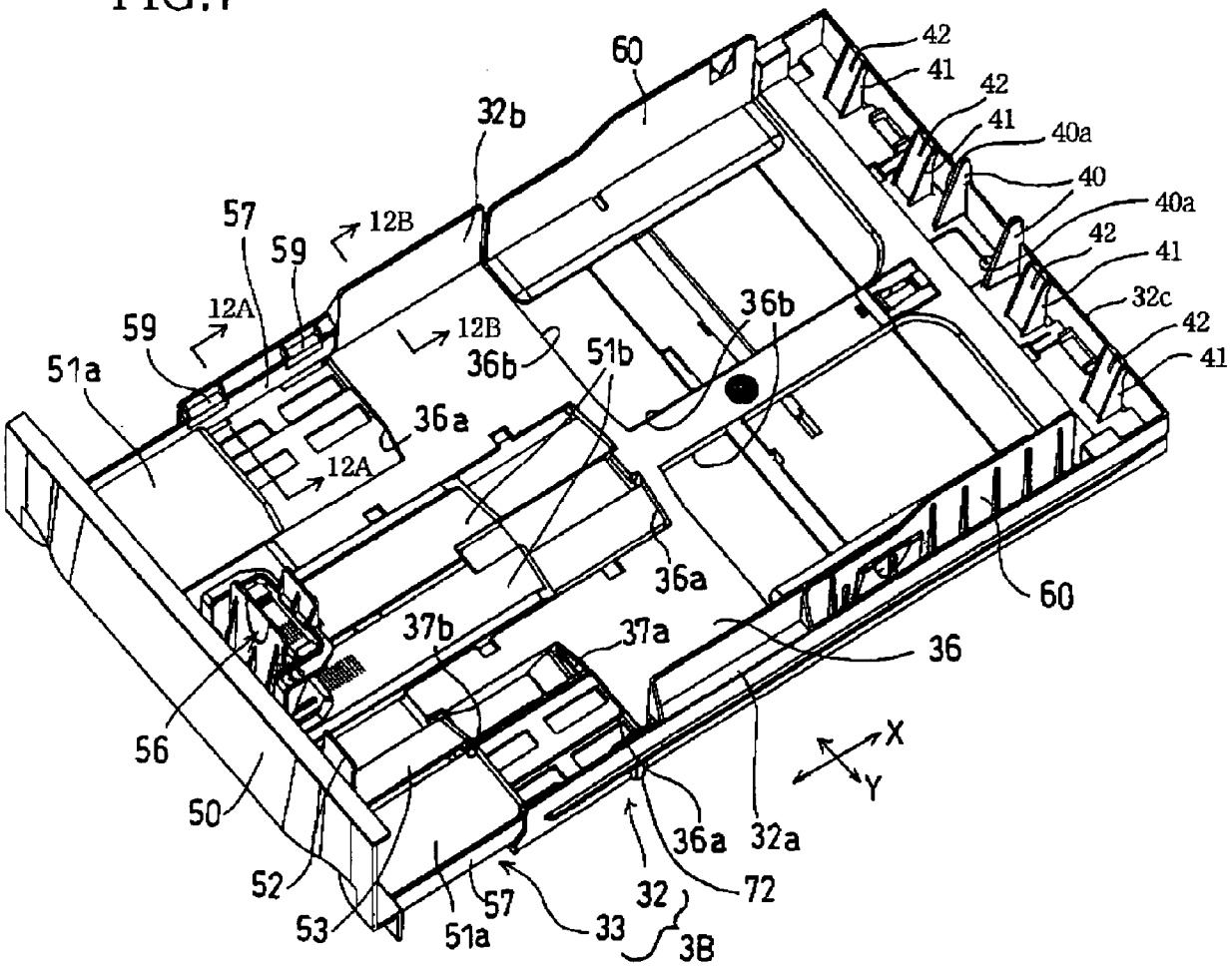
FIG. 7 is a perspective view of the lower sheet-supply cassette in a state in which the overall length of the cassette is extended.
Figure 9:
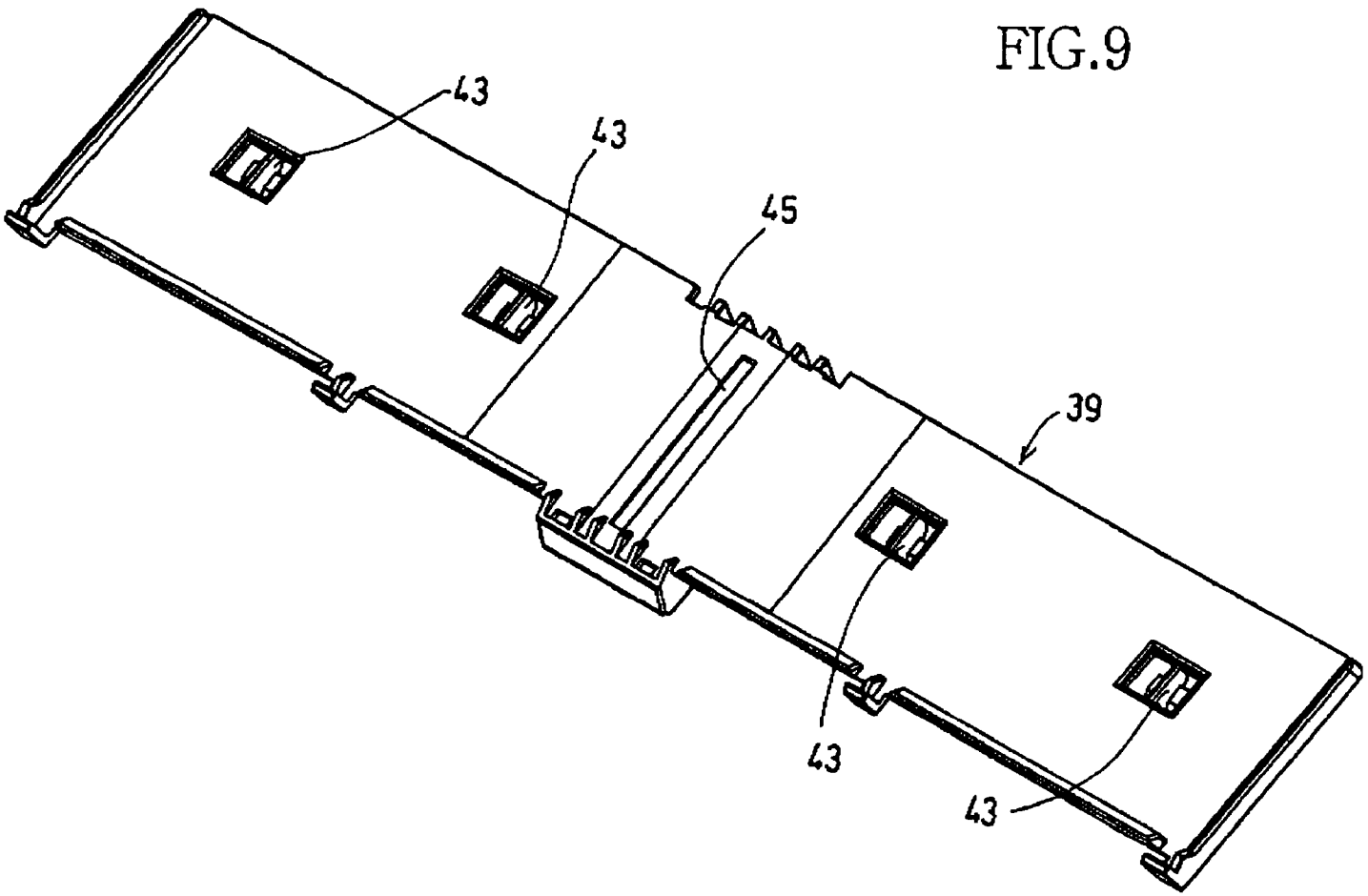
FIG. 9 is a perspective view showing a front surface of an inclined sheet-separate plate for use with the lower sheet-supply cassette.
Figure 10:
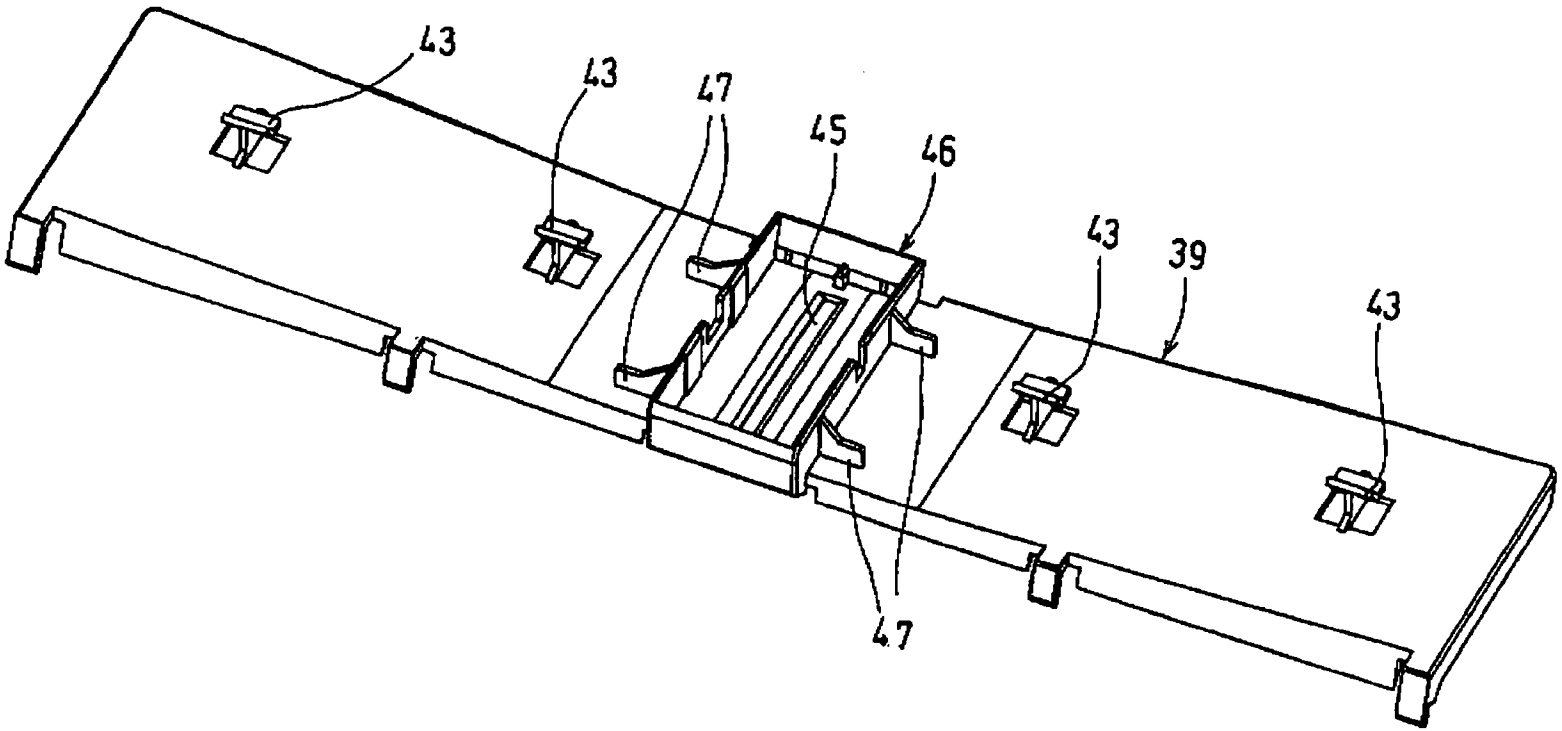
FIG. 10 is a perspective view showing a back surface of the inclined sheet-separate plate.

An inclined sheet-separate plate 39, shown in FIGS. 9 and 10, that is constituted by a single plate is supported, at a back surface thereof, by a plurality of first back-surface support portions 40 each having a trapezoidal shape in its side view, and a plurality of second back-surface support portions 41. The above-described legal-size sheets or letter-size sheets have a width of 215.9 mm, and the inclined sheet-separate plate 39 has a length greater than the width of those sheets P. The first and second back-surface support portions 40, 41 are provided in front of the rear wall 32*c* of the main portion 32, such that the support portions 40, 41 are distant from each other by respective appropriate distances in the Y-axis direction. As shown in FIG. 7, the second back-surface support portions 41 are located nearer to opposite ends of the rear wall 32*c* in the widthwise direction of each cut sheet P than the first back-surface support portions 40. Each of the second support portions 41 has an engaging groove 42 that extends from an upper end thereof in a downward direction. The two first back-surface support portions 40 are located nearer to a middle portion of the rear wall 32*c* in the widthwise direction of each cut sheet P, and are each constituted by a rib having a substantially triangular shape in its side view. The first back-surface support portions 40 have respective inclined surfaces 40*a* that engage and support a plurality of reinforcing ribs 47 (FIG. 10) of the inclined sheet-separate plate 39.

In the present embodiment, the two first back-surface support portions 40 are located at respective positions that are symmetrical with each other with respect to a centerline of the main portion 32 that is parallel to the sheet-feed direction, i.e., is perpendicular to a widthwise direction of the main portion 32 and that are nearer, in the widthwise direction, to the centerline than the respective positions where the four second back-surface support portions 41 are located and which are also symmetrical with each other with respect to the centerline.

The inclined sheet-separate plate 39 is formed by injection molding of a synthetic resin. The inclined plate 39 has, in the back surface thereof, a plurality of engaging claws 43 each of which is formed integrally with the remaining portion of the inclined plate 39 and has a generally T-shaped cross section. The four engaging claws 43 can engage the respective engaging grooves 42 of the four second back-surface support portions 41, when the inclined sheet-separate plate 39 is moved, in a downward direction, toward the main portion 32 by a hand of a person. In addition, as shown in FIGS. 9 and 10, the inclined sheet-separate plate 39 has, in a middle portion thereof in a lengthwise direction thereof (i.e., the Y-axis direction or the widthwise direction of each cut sheet P), a window hole 45 through which an elongate, serrate, elastic sheet-separate pad 44 (FIG. 4) as a sheet-separate portion that is provided on the back surface of the inclined plate 39 is exposed to the front surface of the same 39. Moreover, as shown in FIG. 10, the inclined sheet-separate plate 89 has, in the back surface thereof, an attachment case (i.e., a holder case) 46 that is formed integrally with the remaining portion of the inclined plate 39 and accommodates a support member supporting the elastic pad 44. Each of the reinforcing ribs 47 is partly formed on an outer surface of a corresponding one of the side walls of the attachment case 46, and is partly formed on the back surface of the inclined plate 39. As described above, the reinforcing ribs 47 can engage the respective inclined surfaces 40*a* of the first back-surface support portions 40. Thus, the inclined sheet-separate plate 39 is detachably attached to the first and second back-surface support portions 40, without using a tool.

An enveloping surface that envelopes the respective front surfaces of the first and second back-surface support portions 40, 41 that are opposed to the back surface of the inclined sheet-separate plate 39 is convexly curved such that a middle portion of the enveloping surface in the widthwise direction of each cut sheet P projects from opposite end portions thereof toward the cut sheets P stored in the main portion 32, so that when each cut sheet P is fed forward, widthwise opposite end portions of the cut sheet P contact the opposite end portions of the enveloping surface, at a timing somewhat later than a timing when the widthwise middle portion of the cut sheet P contacts the widthwise middle portion of the enveloping surface.

Therefore, if the inclined sheet-separate plate 39 is moved downward toward the second back-surface support portions 41 such that the engaging claws 43 (i.e., engaging projections as first engaging portions) provided on the back surface of the plate 39 engage the respective engageable grooves 42 (i.e., engaging recesses as second engaging portions) of the second support portions 41, and such that the reinforcing ribs 47 provided on either side of the attachment case 46 engage the inclined surfaces 40*a* of the first back-surface support portions 40, then the front surface of the plate 39 that is opposed to each cut sheet P is also convexly curved like an arc, in its plan view, such that a middle portion of the front surface in the widthwise direction of each cut sheet P projects from opposite end portions thereof toward the cut sheets P stored in the main portion 32, so that when each cut sheet P is fed forward, widthwise opposite end portions of the cut sheet P contact the opposite end portions of the enveloping surface, at a timing somewhat later than a timing when the widthwise middle portion of the cut sheet P contacts the widthwise middle portion of the enveloping surface.

In a modified form of the present embodiment, the inclined sheet-separate plate 39 may be formed of an elastically deformable, semi-hard synthetic resin to have a flat shape. In this case, the engaging claws 43 provided on the back surface of the plate 39 are engaged with the respective engageable grooves 42 of the second back-surface support portions 41, by elastically deforming the lengthwise opposite end portions of the plate 39 in respective directions away from the widthwise opposite end portions of each cut sheet P. In this state, the respective inclined surfaces 40*a* of the first back-surface support portions 40 located in the middle portion of the rear side wall 32*c* in the widthwise direction of each cut sheet P engage the reinforcing ribs 47 of the plate 39, such that the inclined surfaces 40*a* press back the reinforcing ribs 47. In this case, too, the front surface of the inclined sheet-separate plate 39 is convexly curved like an arc, in its plan view.

Thus, the middle portion of the front surface of the inclined sheet-separate plate 39 in the widthwise direction of each cut sheet P projects such that the middle portion of the front surface contacts a leading end of the cut sheet P being fed, prior to the opposite end portions of the front surface, and the opposite end portions subsequently contact the leading end. Thus, the elastic sheet-separate pad 44 as the frictional member that is located in the lengthwise middle portion of the plate 39 can surely separate the cut sheets P, one by one. In addition, since the inclined sheet-separate plate 39 does not simultaneously contact all portions of the leading end of each cut sheet P, a frictional resistance produced between the each cut sheet P and the plate 39 lowers, and accordingly the each cut sheet P can be smoothly separated from the other cut sheets P, that is, jamming of the cut sheets P can be effectively prevented.

In each of the above-described embodiments, the inclined sheet-separate plate 39 is formed independent of the main portion 32 of the lower sheet-supply cassette 3B, and then the plate 39 is assembled with the first and second back-surface support portions 40, 41. Therefore, the three-dimensional convexly curved shape (i.e., the arcuate shape) of the front surface of the plate 39 can be considerably easily formed.

In addition, since the first and second back-surface support portions 40, 41 are provided at the respective positions that are symmetrical with each other with respect to the centerline of the main portion 32 that is perpendicular to the widthwise direction of each cut paper P, the arcuately curved front surface of the inclined sheet-separate plate 39 can be easily formed symmetrically with respect to the centerline. Consequently the frictional resistance is produced between the front surface of the plate 39 and the leading end of each cut sheet P being fed, symmetrically with respect to the centerline, and accordingly the cut sheet P can be fed without being deflected and the jamming of the cut sheets P can be effectively prevented.

Moreover, since the inclined sheet-separate plate 39 is formed independent of the main portion 32 of the lower sheet-supply cassette 3B, the sheet-separate pad 44 can be easily attached to the pad-holding case 46 provided on the back surface of the plate 39.

Figure 11:
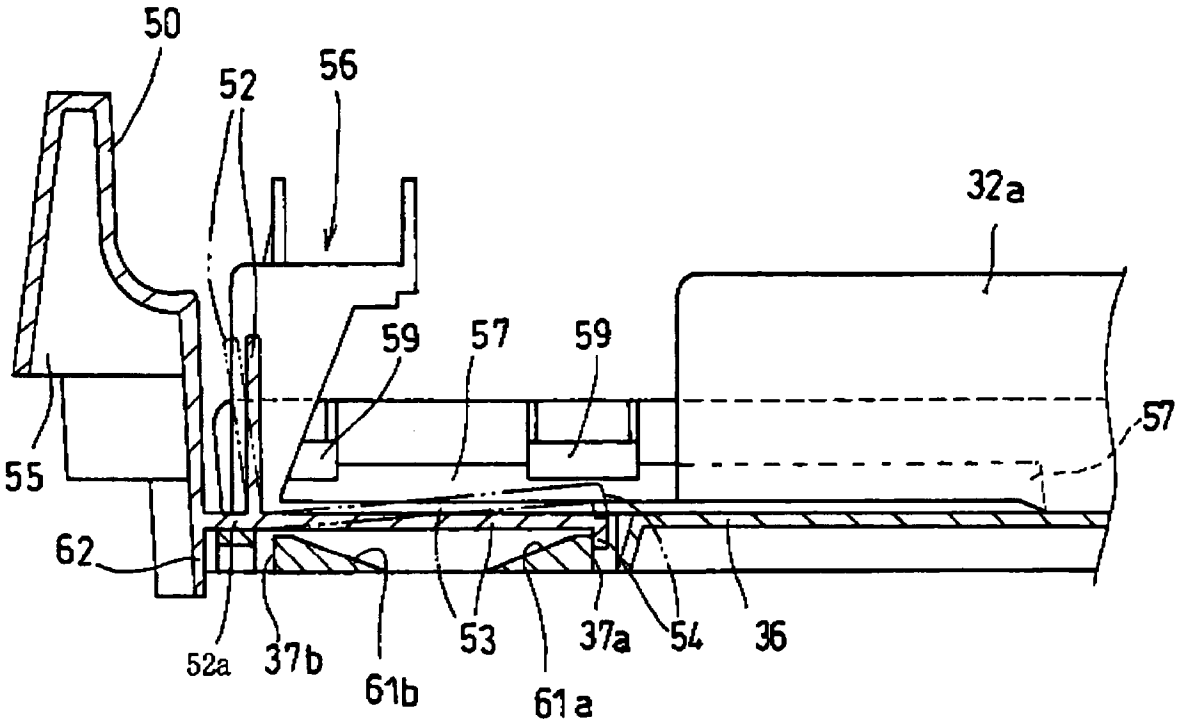
FIG. 11 is an enlarged, cross-section view taken along 11-11 in FIG. 6.

As shown in FIGS. 2, 6, 7, and 11, the auxiliary portion 33 includes a front wall 50 that can close the opening 21*a* of the front wall of the second lower case 21; two side support plates 51*a* that extend horizontally from a lower portion of the front wall 50 and cooperate with each other to support the respective rear end portions of the cut sheets P; a middle support plate 51*b* that is located between the two side support plates 51*a,* extend horizontally from the lower portion of the front wall 50, and cooperate with the two side support plates 51*a* to support the respective rear end portions of the cut sheets P; a plate-like operable portion 52 that stands upright so as to be opposed to an inner surface of the front wall 50; and a support plate 53 that extends from a lower end of the operable portion 52, in the sheet-feed direction. As shown in FIG. 11, the support plate 53 has, in a free end portion thereof, an engaging claw 54 as a second engaging portion that extends downward; and the front wall 50 has, on an outer side thereof a handle portion 55 opening downward. Respective base portions of the operable portion 52 and the support plate 53 are integrally formed with an elastically deformable connection portion 52*a* that integrally protrudes from the lower portion of the front wall 50 and is elastically deformable upward and downward. Thus, in the auxiliary portion 33, the front wall 50 is integrally formed with the operable portion 52 and the support plate 53 including the engaging claw 54 that can selectively engage an appropriate one of the engaging grooves (i.e., the first engaging portions) 37*a,* 37*b* that are formed in the main portion 32 such that the grooves 37*a,* 37*b* are distant from each other by an appropriate distance in the sheet-feed direction.

The two side support plates 51*a,* the middle support plate 51*b,* and the support plate 53 of the auxiliary portion 33 are accommodated by the front low stepped portions 36*a* of the bottom plate 36 of the main portion 32, such that respective upper surfaces of the plates 51*b*, 51*b,* 53 are flush with an upper surface of the bottom plate 36. Therefore, the lowermost one of the cut sheets P stacked in the lower sheet-supply cassette 3B is supported by a flat surface defined by the respective upper surfaces of the plates 51*b,* 51*b,* 53, 36.

Figure 12A:
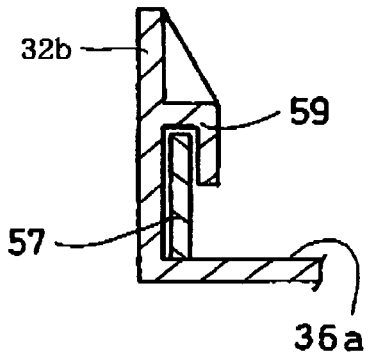
FIG. 12A is an enlarged cross-section view taken along 12A-12A in FIG. 7.
Figure 12B:
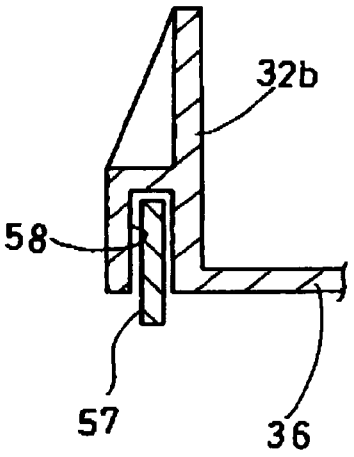
FIG. 12B is an enlarged cross-section view taken along 12B-12B in FIG. 7.
Figure 13:
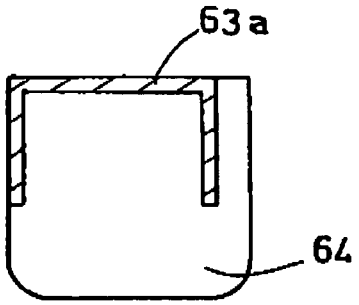
FIG. 13 is a cross-section view taken along 13-13 in FIG. 4.

The auxiliary portion 83 additionally has two guide plates 57 that are located outside the two side support plates 51 a, respectively, are formed integrally with the same 51*a*, respectively, are short in height, and extend in the sheet-feed direction. As shown in FIGS. 12A and 12B, the two guide plates 57 are slideably insertable into two guide grooves 58, respectively, which are formed in the two side walls 32*a,* 32*b* of the main portion 32, respectively, and each of which opens downward and frontward. Each of the two side walls 32*a,* 32*b* has, on an inner surface thereof, a plurality of hold-down portions 59 that engage an upper surface of a corresponding one of the two guide plates 57. Therefore, even if the auxiliary portion 33 is largely drawn or extended from the main portion 32, as shown in FIG. 7, the front wall 50 can be effectively prevented from being tilted downward. In other words, the respective upper surfaces of the two side support plates 51*a,* the middle support plate 51*b,* and the support plate 53 are kept flush with the upper surface of the bottom plate 36 of the main portion 32. FIGS. 12A and 12B show only the guide groove 58 and the hold-down portions 59 formed in the left-hand side wall 32*b* as seen in FIG. 7.

A sheet-rear-end guide member 56 as a positioning member that engages the respective rear ends of the cut sheets P and thereby positions the same P in the sheet-feed direction, is attached to an upper surface of the middle support plate 51*b* of the auxiliary portion 33, such that the guide member 56 is slidable in the sheet-feed direction with the user's hand while the hand feels clicks. The bottom plate 36 of the main portion 32 additionally has two rear low stepped portions 36*b* that accommodate two sheet-side-end guide members 60, respectively, that guide two widthwise opposite sides of each of the cut sheets P, respectively, and cooperate with each other to position the each cut sheet P symmetrically with respect to the centerline of the main portion 32, in the widthwise direction of the each cut sheet P. To this end, the two guide members 60 are slidable in the widthwise direction of the main portion 32.

The lower sheet-supply cassette 3B constructed as described above is used in the following manner: For example, when the A4-size cut sheets P are stacked and stored in the lower cassette 3B such that the lengthwise direction of the cut sheets P is parallel to the sheet-feed direction, first, the thumb of the user's hand is applied to the outer surface of the front wall 50, and the index and middle fingers are applied to the plate-like operable portion 52, and then an external force is so applied as to decrease the distance between the inner surface of the front wall 50 and the upper portion of the operable portion 52. Consequently the connection portion 52*a* that integrally protrudes from the lower portion of the front wall 50 and is elastically deformable upward and downward is elastically deformed upward, so that the free end portion of the support plate 53 is moved upward, as indicated at two-dot chain line in FIG. 11. Thus, the engaging claw 54 is disengaged from one engaging groove 37*b* located on the upstream side of the other engaging groove 37*a* as seen in the sheet-feed direction. In this state, the auxiliary portion 33 is pushed into the front end portion of the main portion 32. Then, the external force being applied to the operable portion 62 is released. Once the engaging claw 54 is engaged with the other engaging groove 37*a* located on the downstream side in the sheet-feed direction, the lower cassette 3B is kept in the state in which the overall length thereof in the sheet-feed direction is decreased.

On the other hand, when the legal-size cut sheets P longer than the A4-size cut sheets P are stored in the lower cassette 3B, the auxiliary portion 38 is operated in reverse. More specifically described, first, an external force is applied to the operable portion 52, so as to disengage the engaging claw 54 provided in the free end portion of the support plate 53, from the downstream engaging groove 37*a.* In this state, the auxiliary portion 33 is drawn from the front end portion of the main portion 32, so that the engaging claw 54 engages the upstream engaging groove 37*b.* Thus, the lower cassette 3B is kept in the state in which the overall length thereof is increased.

As shown in FIG. 11, the bottom plate 36 of the main portion 32 has two gentle-slope surfaces 61*a,* 61*b* that are located between the two engaging grooves 37*a,* 37*b* such that the two gentle-slope surfaces 61*a,* 61*b* are opposed to each other in the sheet-feed direction. Therefore, in the state in which the engaging claw 54 is disengaged from one of the two engaging grooves 37*a,* 37*b,* the auxiliary portion 33 can be drawn or pushed relative to the main portion 32, without needing the application of external force to the operable portion 52. Thus, the engaging claw 54 can be smoothly engaged with the other engaging groove 37*a,* 37*b.*

As described above, the operable portion 52 is provided at the position deviated by the appropriate distance in one direction from the widthwise middle portion of the lower sheet-supply cassette 3B. This arrangement is convenient for the user to move the auxiliary portion 33 frontward and rearward by applying, with one hand, the external force to the operable portion 52 and grasping, with the other hand, the front wall 50, i.e., the handle portion 55 thereof. In addition, the front wall 50 of the auxiliary portion 33 has, in a lower end portion thereof, a support leg portion 62 that is formed integrally with the remaining portion of the front wall 50 and supports the auxiliary portion 33 at substantially the same height as a height at which the main portion 32 is supported by the second lower case 21. This arrangement assures that when the auxiliary portion 33 is moved frontward or rearward, the respective upper surfaces of the two side support plates 51*a*, the middle support plate 51*b*, and the support plate 53 can be kept flush with the upper surface of the bottom plate 36 of the main portion 32. Thus, the cut sheets P stacked in the lower cassette 3B are effectively prevented from being bent or wrinkled.

As shown in FIGS. 2, 4, 5, and 13, the second lower case 21 that accommodates the lower sheet-supply cassette 3B has a plurality of reinforcing beams 63*a*, 63*b*, 63*c* that extend in a a widthwise direction of the second case 21 that is perpendicular to the sheet-feed direction, and connect between respective upper portions of widthwise opposite end portions of the lower case 21. The first beam 63*a* as the most downstream one of the three beams 63*a*, 63*b*, 63*c* as seen in the sheet-feed direction has, on a lower surface thereof, a plurality of guide ribs 64 which are formed integrally with the remaining portion of the first beam 63*a* and each of which extends in the sheet-feed direction and additionally functions as a reinforcing member. Owing to the guide ribs 64, even in the case where a large number of cut sheets P up to, e.g., about 250 sheets P are stacked in the lower cassette 3B, a sheet-feed roller 65*b* of a sheet feeding device 65 can be rotated to separate and feed the sheets P, one by one, without causing jamming of each sheet P with the beam 63*a*.

Figure 6:
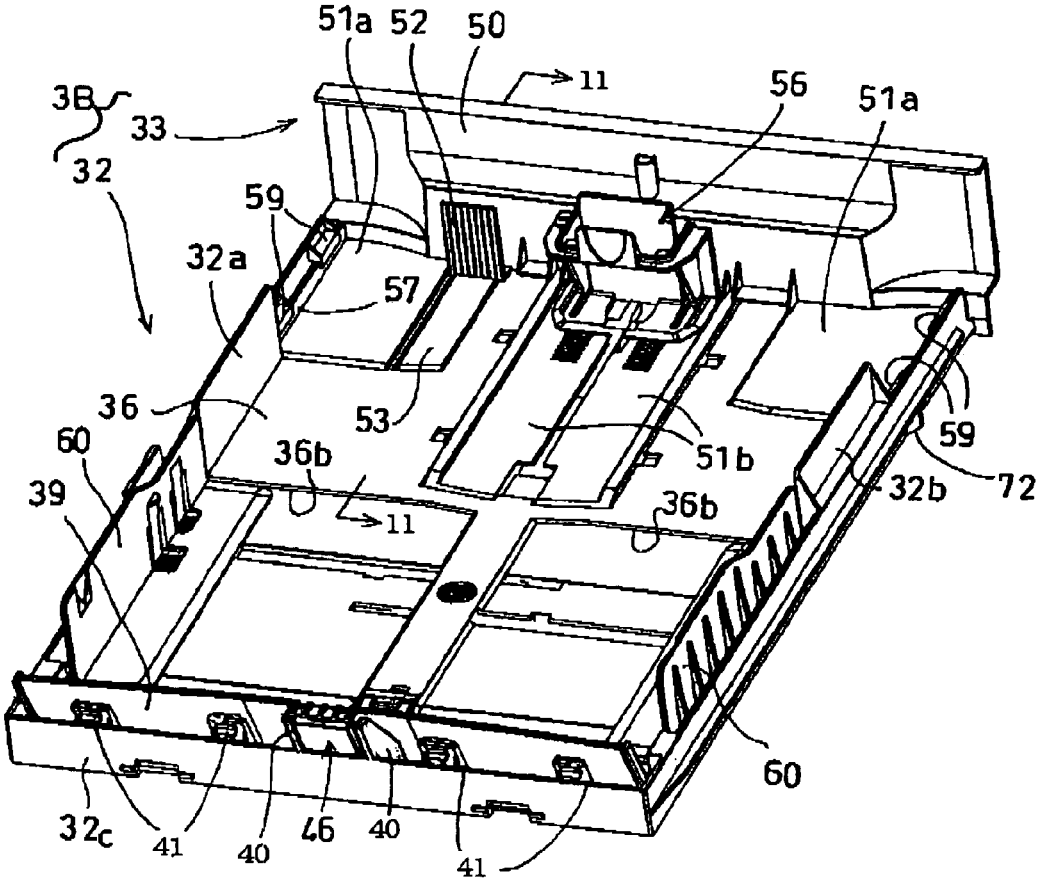
FIG. 6 is a perspective view of the lower sheet-supply cassette in a state in which an overall length of the cassette is reduced.
Figure 14:
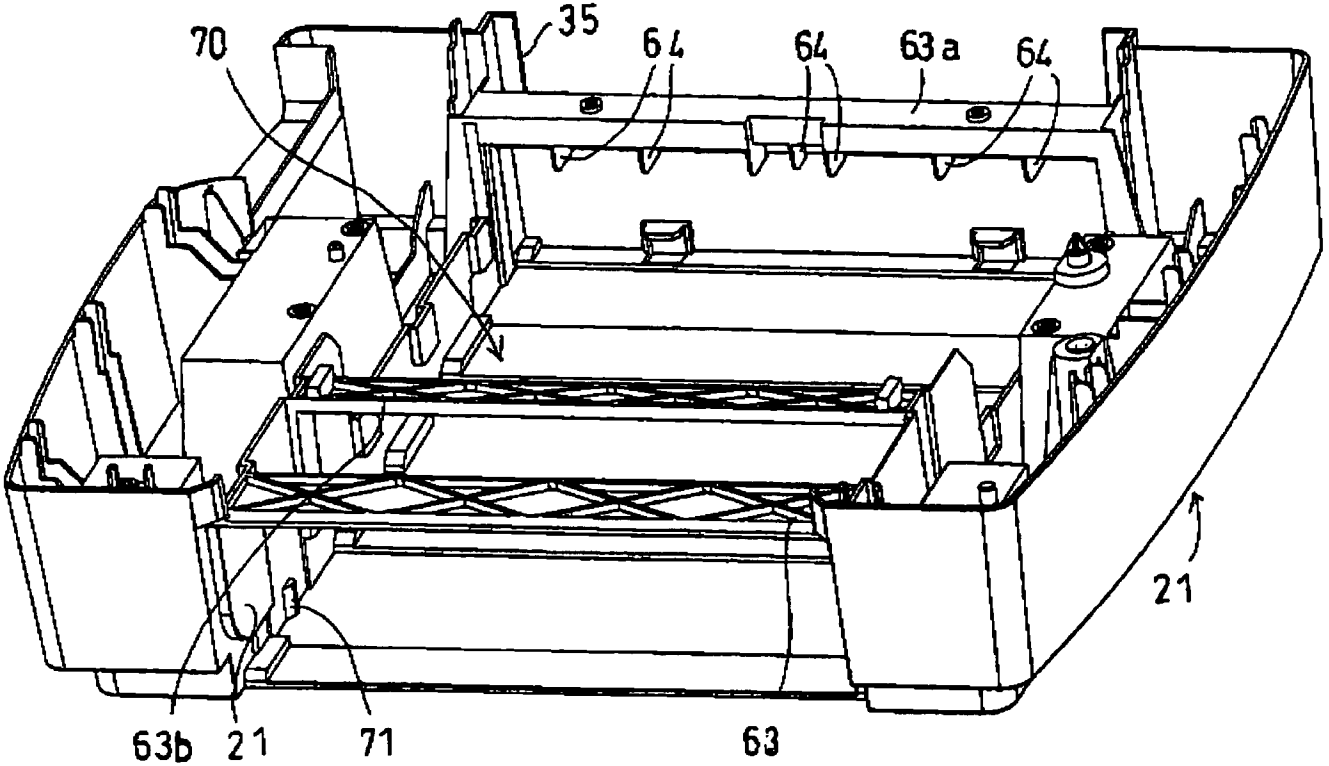
FIG. 14 is a perspective view showing a state in which the lower sheet-supply cassette is removed from the second lower case.

As shown in FIG. 14, the second lower case 21 has an insertion passage 70 in and from which the lower sheet-supply cassette 3B is inserted and drawn. The second lower case 21 has two first restrictor projections 71 (only one projection 71 is shown in the figure) which project into the insertion passage 70 and each of which has a generally triangular shape in its plan view. The restrictor projections 71 are provided at respective positions that are intermediate in the direction of insertion of the lower cassette 3B and are opposed to the respective outer surfaces of the two side walls 32*a*, 32*b* of the main portion 32. In addition, as shown in FIGS. 6 through 8, the two side walls 32*a*, 32*b* of the main portion 32 have, on the respective outer surfaces thereof, two second restrictor projections 72 (only one projection 72 is shown in the figures) each of which has a generally triangular shape in its plan view and which are provided at respective positions that are intermediate in a lengthwise direction of the main portion 32, i.e., the direction of insertion of the lower cassette 3B. When the lower cassette 3B is inserted in the insertion passage 70, the second restrictor projections 72 thereof temporarily engage, and climb over, the first restrictor projections 71 of the second case 21, respectively. Thus, the first and second restrictor projections 71, 72 cooperate with each other to provide a snap-action device, or a pair of gap reducing devices. Owing to the snap-action device or the gap reducing devices, the user's hand can feel a click when inserting or drawing the lower cassette 3B in or from the second case 21. It is preferred that the user's hand may feel the click when an almost entire portion of the lower cassette 3B has been inserted in the insertion passage 70 of the second case 21. To this end, the first restrictor projections 71 are provided at respective positions near to the opening 21*a* of the second case 21, and the second restrictor projections 72 are provided at respective positions near to the front wall 50 of the lower cassette 3B.

Figure 4:
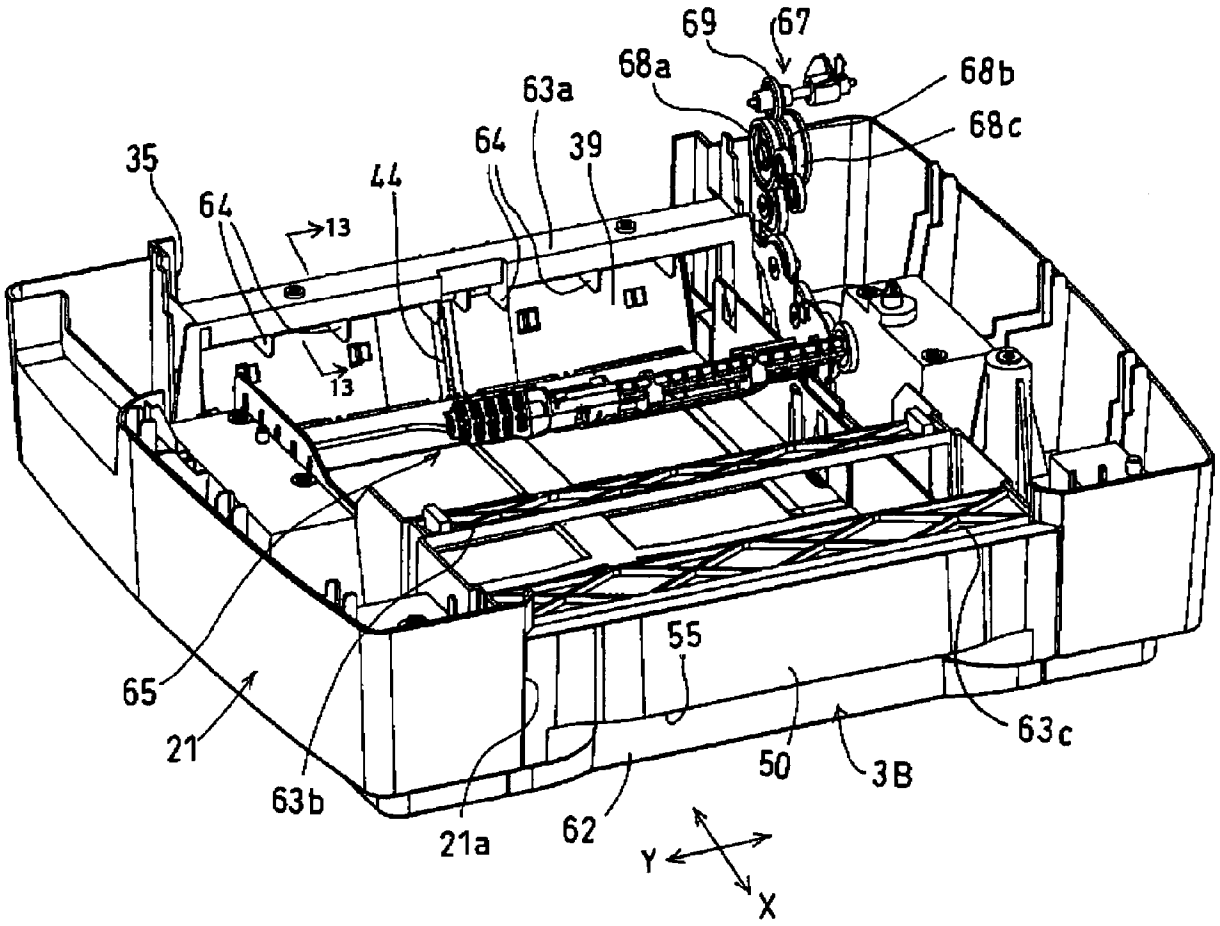
FIG. 4 is a perspective view showing a state in which a lower one of the two sheet-supply cassettes is inserted in a second lower case of the image recording apparatus.
Figure 5:
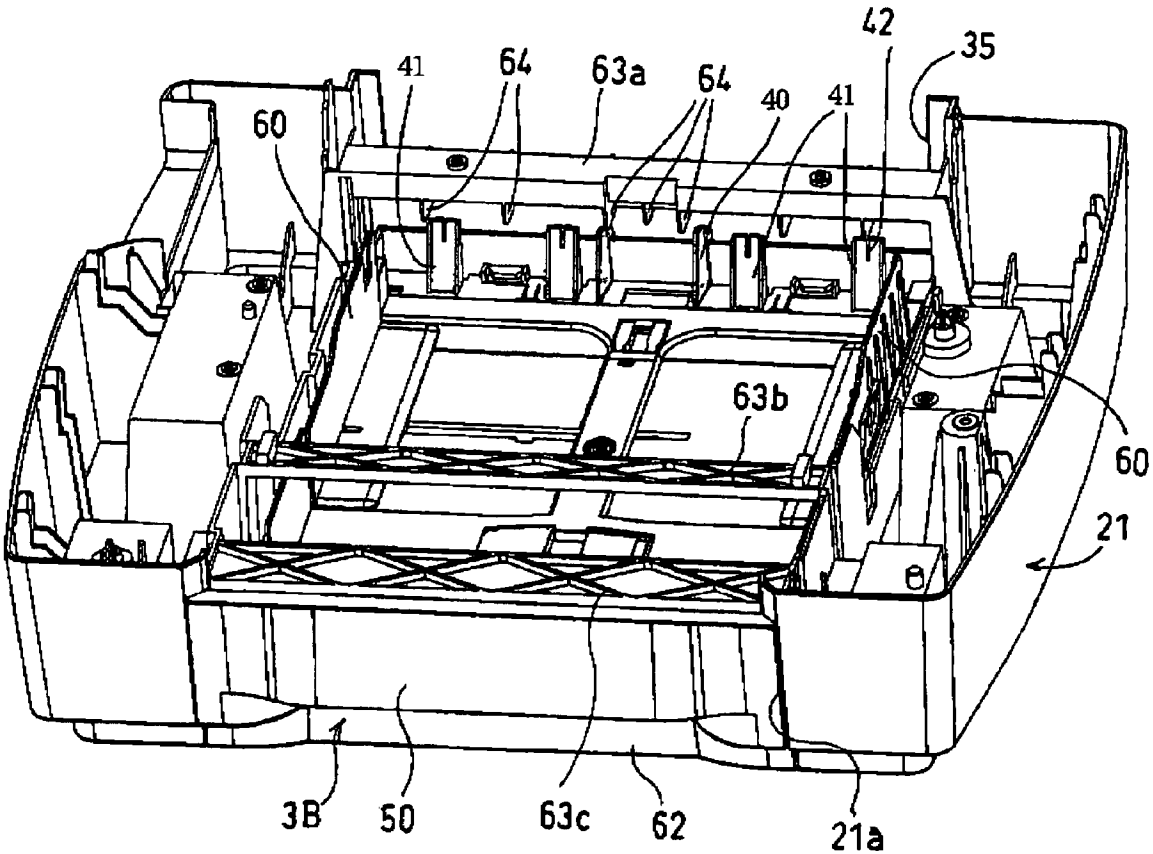
FIG. 5 is another perspective view, taken from a different angle, that shows the state in which the lower sheet-supply cassette is inserted in the second lower case.

FIG. 4 shows a switching device 67 that selectively transmits an output power of a drive source, not shown, to either one of a first power transmission gear, not shown, for the sheet feeding device 65 of the lower sheet-supply cassette 3B, a second power transmission gear, not shown, for the sheet feeding device 6 of the upper sheet-supply cassette 3A, and a third power transmission gear for a maintenance device, not shown. The switching device 67 includes three gears 68*a*, 68*b*, 68*c* with either one of which a drive gear 69 is selectively engaged according to an amount of movement of the carriage 5 in a rightward direction in FIG. 4.

While the present invention has been described in its preferred embodiments, it is to be understood that the present invention is by no means limited to the details of the described embodiments but may otherwise be embodied.

For example, in each of the above-described embodiments, the image recording apparatus 1 employs the plurality of sheet-supply cassettes 3A, 3B. However, the principle of the present invention is applicable to an image recording apparatus employing a single sheet-supply cassette only.

It is to be understood that the present invention may be embodied with various changes, modifications, and improvements that may occur to a person skilled in the art without departing from the spirit and scope of the invention defined in the appended claims.

The invention claimed is:

1. A sheet-supply device for an image forming apparatus, comprising:

a sheet holding portion having a sheet holding surface on which a plurality of sheets are to be held;

two side guides which guide two widthwise opposite sides of each of the plurality of sheets, respectively;

a sheet feeder configured to feed the sheets held on the sheet holding surface;

a support member including a plurality of first engaging portions; and a sheet-separation unit detachably attached to the support member, the sheet-separation unit including:

a plurality of inclined surfaces which are inclined relative to the sheet holding surface of the sheet holding portion, each of the inclined surfaces facing obliquely upward and extending obliquely from a bottom position thereof adjacent to the sheet holding surface of the sheet holding portion to a top position thereof, such that, when one of the sheets is fed by the sheet feeder in a sheet-feed direction to the inclined surfaces, the sheet-separation unit guides a leading end of the one of the sheets in an obliquely upward direction along the inclined surfaces;

a plurality of second engaging portions each of which is configured to be engaged with a corresponding one of the plurality of first engaging portions when the sheet-separation unit is attached to the support member, and to be disengaged from the corresponding one of the plurality of first engaging portions when the sheet-separation unit is detached from the support member; and a separator configured to, when the one of the sheets is fed to the separator by the sheet feeder, separate the one of the sheets from a next one of the sheets, wherein the sheet-separation unit has an opening between the inclined surfaces and the separator protrudes relative to the inclined surfaces through the opening, and wherein the sheet-separation unit is disposed downstream of the sheet holding surface in the sheet-feed direction and extends, in a widthwise direction of the plurality of sheets that is perpendicular to the sheet-feed direction, at least a distance between a first position corresponding to a first of the two side guides and a second position corresponding to a second of the two side guides.

2. The sheet-supply device according to claim 1, wherein the sheet-separation unit further includes a case portion configured to accommodate the separator.

3. The sheet-supply device according to claim 2, wherein the case portion is open obliquely downward.

4. The sheet-supply device according to claim 1, wherein the sheet holding portion and the support member are formed integrally.

5. The sheet-supply device according to claim 1, wherein the separator includes a pad.

6. The sheet-supply device according to claim 1, wherein the separator includes an elastic member.

7. The sheet-supply device according to claim 1, wherein, in a state in which the sheet-separation unit is attached to the support member, the sheet-separation unit is removable integrally with the sheet holding portion.

8. The sheet-supply device according to claim 1, wherein the separator is elongate in a direction in which the leading end of the one of the sheets is to be guided by the sheet-separation unit.

9. The sheet-supply device according to claim 1, wherein the feeder includes a feed roller configured to rotate to feed the one of the sheets and an arm configured to swingably support the feed roller.

10. The sheet-supply device according to claim 1, wherein the plurality of second engaging portions are disposed at a back surface of the inclined surfaces.

* * * * *